US007067749B1

(12) United States Patent
Cantolino

(10) Patent No.: US 7,067,749 B1
(45) Date of Patent: Jun. 27, 2006

(54) FLOAT SWITCH AND MOUNTING SYSTEM ASSEMBLY

(76) Inventor: Christopher Ralph Cantolino, 7704 18th Ave. NW., Bradenton, FL (US) 34209

( * ) Notice: Subject to any disclaimer, the term of this patent is extended or adjusted under 35 U.S.C. 154(b) by 0 days.

(21) Appl. No.: 10/932,967

(22) Filed: Sep. 2, 2004

(51) Int. Cl.
*H01H 35/18* (2006.01)

(52) U.S. Cl. ..... 200/84 R

(58) Field of Classification Search .... 200/84 R–84 C, 200/293; 73/305–309, 317–322.5; 338/33; 340/618–625
See application file for complete search history.

(56) References Cited

U.S. PATENT DOCUMENTS 2,905,783 A * 9/1959 Johnson, Jr. ..... 200/84 R
3,757,318 A * 9/1973 Brisson ..... 340/565
4,183,176 A * 1/1980 Barfield ..... 47/79
4,757,305 A * 7/1988 Peso ..... 340/624
4,833,441 A * 5/1989 Okada et al. ..... 340/450
5,862,702 A * 1/1999 Liang ..... 73/313
6,513,378 B1 * 2/2003 Love, Jr. ..... 73/313
6,681,627 B1 * 1/2004 Li ..... 73/307
6,730,865 B1 * 5/2004 Hernandez-Zelaya ..... 200/84 R

* cited by examiner

*Primary Examiner*—Michael A. Friedhofer
(74) *Attorney, Agent, or Firm*—Dorothy S. Morse

(57) ABSTRACT

A float switch and mounting bracket assembly made from plastic and impervio is to corrosion, with improvements over the prior art including a wide float switch body for enhanced water displacement that results in a more responsive operation, a housing that protects its float switch body from malfunction due to airborne debris, three oversized thumbscrews to facilitate and expedite installation, multiple crushable friction points within the top of the mounting bracket slot that stabilize the orientation of the bracket after installation, and longer lead wires and a higher voltage that allow use of the float switch and mounting bracket assembly in a wide variety of condensate collection and other applications.

20 Claims, 4 Drawing Sheets

FLOAT SWITCH AND MOUNTING SYSTEM ASSEMBLY

CROSS-REFERENCES TO RELATED APPLICATIONS

None

BACKGROUND OF THE INVENTION

1. Field of the Invention

This invention relates to liquid-level float switches, specifically to a float switch and mounting system assembly of sturdy construction that is primarily contemplated for use in condensate collection applications, but which is also useful in a variety of other applications. The most preferred embodiment of the present invention comprises an adjustable float switch body with the amount of its vertical movement relative to a concentrically positioned shaft being adjustably defined by an upper lock-nut and a disk-shaped bottom stop that are both connected to the shaft, with the float switch body also having a large surface area for enhanced buoyancy and improved responsiveness during operation; a shroud or housing configured and positioned to protect float switch body movement from interference due to airborne debris, with the housing/shroud being closely positioned around the float switch body and having an open bottom end, the housing/shroud also having a threaded central aperture through its top surface configured for aligning the upper end of the shaft as it guides the vertical displacement of the float switch body, and the shroud/housing further having a minimum of small air vent openings in its top surface that are configured and dimensioned to prevent float switch body malfunction as a result of an airlock created by fluid entering the housing through its open bottom end; a substantially U-shaped mounting bracket with one of its arms depending laterally from one side of the housing, the mounting bracket having an upwardly directed slot configured for being positioned over the upper edge of a vertically-extending support surface, with the other arm of the U-shaped bracket having several horizontally-extending threaded bores therethrough each being configured for the insertion of one thumbscrew used for tightening the bracket against a support surface positioned within its slot, and further having a plurality of crushable friction points within the top portion of the slot that are configured to conform to uneven surfaces and further stabilize the installed bracket to prevent changes in its orientation that could diminish float switch body function; and a higher voltage and longer lead wires than are commonly used with other pan-mounted float switches for connection to a fluid generation source to interrupt its operation, for increased versatility in adaptating the present invention to new applications.

2. Description of the Related Art

When air conditioning condensate and other condensates are collected, there is often a risk of overflow or back-up into the system producing it. As a result, liquid-level float switches have been employed with collection pans to shut-off the source of condensate flow when the amount of fluid collected exceeds a predetermined depth. However, currently known float switches are deficient in many ways and thereby subject to malfunction, less responsive operation, more costly installation, and/or unstable installation. First, the collection pans used for condensate collection do not always have a sturdy construction. Therefore, when the upstanding pan wall to which a float switch is attached bends as a result of the switch mounting, the float switch tends to lean in over time and when it does it is no longer mounted in a level orientation, making it less responsive. Further, depending upon the location of the collection pan, a float switch mounted thereto may be at risk for malfunction as a result of airborne debris, such as but not limited to the insulation fibers often encountered in attics where air conditioning system condensing units are located. Also, prior art liquid-level float switches tend to have float switch bodies that wobble relative to the shaft with which they are associated, a condition that can lead to less responsive operation or malfunction. Typically, also, the installation of prior art float switches requires the drilling of at least one hole, which increases installation cost. In addition, some float switches are at risk for premature malfunction as a result of being made from materials that are not completely corrosion-resistant. In contrast, the present invention is made from plastic that is impervious to corrosion. Its float switch body is wider than those of known prior art float switches for greater water displacement, and it contains a shroud/housing that protects its float switch body from malfunction due to airborne debris. In addition, it has three thumbscrews to facilitate and expedite mounting bracket installation, with no drilling required, it has longer lead wires than are typically provided with other liquid-level float switches, and its voltage is higher than that of other liquid-level float switches for use in a wider variety of applications.

BRIEF SUMMARY OF THE INVENTION—OBJECTIVES AND ADVANTAGES

The primary object of the present invention is to provide a float switch and mounting system assembly for use with condensate collection pans to shut-off condensate flow when the amount collected exceeds a predetermined depth. It is also an object of the present invention to provide a float switch and mounting system assembly that has cost-effective construction for widespread distribution and use. It is a further object of the present invention to provide a float switch that is sturdy in construction for responsive and reliable operation. A further object of the present invention to provide a float switch and mounting system assembly designed for prompt and cost effective installation. It is also an object of the present invention to provide a float switch and mounting system assembly that is capable of being securely installed and will remain substantially in its original orientation during its entire period of use. Another object of the present invention is to provide a float switch and mounting system assembly with a design that compensates for insubstantial condensate collection pan construction, to prevent the float switch body from leaning in during use. A further object of this invention is to provide a float switch and mounting system assembly that has a means of self-protection against malfunction due to airborne debris, such as the loose insulation fibers typically encountered in attics with some air conditioning applications. In addition, it is a further object of the present invention to provide a float switch and mounting system assembly that is made from corrosion-resistant materials that resist premature deterioration and malfunction.

As described herein, properly manufactured and used, the present invention would provide a float switch and mounting system assembly that can be used to shut-off the flow of condensate or other fluid when the amount of it collected in a pan or other container associated with the present invention reaches a pre-determined maximum depth. The present invention is typically made from plastic, and thereby impervious to corrosion, which in combination with its sturdy construction avoids premature deterioration. Also, its float switch body is wider than prior art float switches for greater water displacement, and it contains a shroud/housing protects its float switch body from malfunction due to airborne debris, both of which contribute to more responsive and reliable operation than is possible with other prior art float switches capable of fulfilling the same function. In addition, it has three thumbscrews to facilitate and expedite installation, the amount of vertical float switch body displacement is adjustable, its voltage is higher, and its lead wires are longer, all of which make the present invention readily adaptable to a wide variety of applications and changing needs. Further, the thumbscrews provided that prevent the need for drilling holes in a support surface make installation of the present invention efficient and cost-effective, and the design of the present invention provides sturdy and cost-effective construction. In addition, installation of the present invention via its slot, thumbscrews, and crushable friction points provides for secure connection of the present invention to a support surface, even when the support surface is uneven, with the wide and upwardly-extending mounting bracket slot compensating for weak condensate collection pan construction so as to prevent the float switch body from leaning in during use and potentially becoming less responsive. Also, the housing/shroud protects the float switch body against malfunction due to contact with airborne debris, such as but not limited to the loose insulation fibers that are often encountered in attics during air conditioning applications.

Although the description herein provides preferred embodiments of the present invention, it should not be construed as limiting the scope of the present invention float switch and mounting system assembly. For example, variations in the height and diameter of the shaft used; the number of threads used on the upper portion of the shaft for housing/shroud connection; the size, number, configuration and relative spacing of the air vent openings in the upper surface of the housing/shroud; the size, location, number and relative spacing of the thumbscrew openings in the mounting bracket connected to the housing/shroud; the depth and width of the upwardly-extending slot in the U-shaped mounting bracket; the comparative height dimensions of the housing/shroud and the mounting bracket; the relative height dimensions of the float switch body, housing/shroud, and shaft; the configuration and dimension of the housing/shroud as long as it allows for unrestricted vertical float switch body movement without unnecessary material expense; and the perimeter configuration and dimension of the lock-nut used to tighten the shaft to the housing/shroud; in addition to those variations shown and described herein, may be incorporated into the present invention. Thus, the scope of the present invention should be determined by the appended claims and their legal equivalents, rather than being limited to the examples given.

Figure 6:
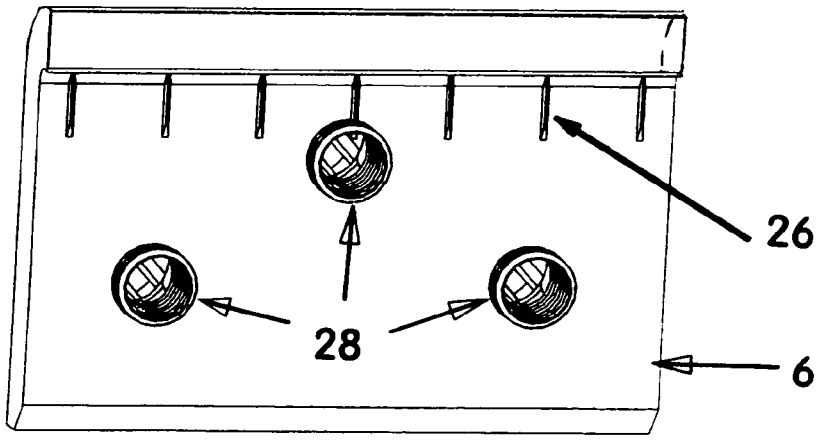

FIG. 6 is a sectional view of the U-shaped mounting bracket in the most preferred embodiment of the present invention having the one of its arms remote from the housing/shroud displaying a plurality of spaced-apart stabilizing crushable friction points near the top inside surface of the slot and three spaced-apart threaded openings each configured for securely holding one thumbscrew.

Figure 7:
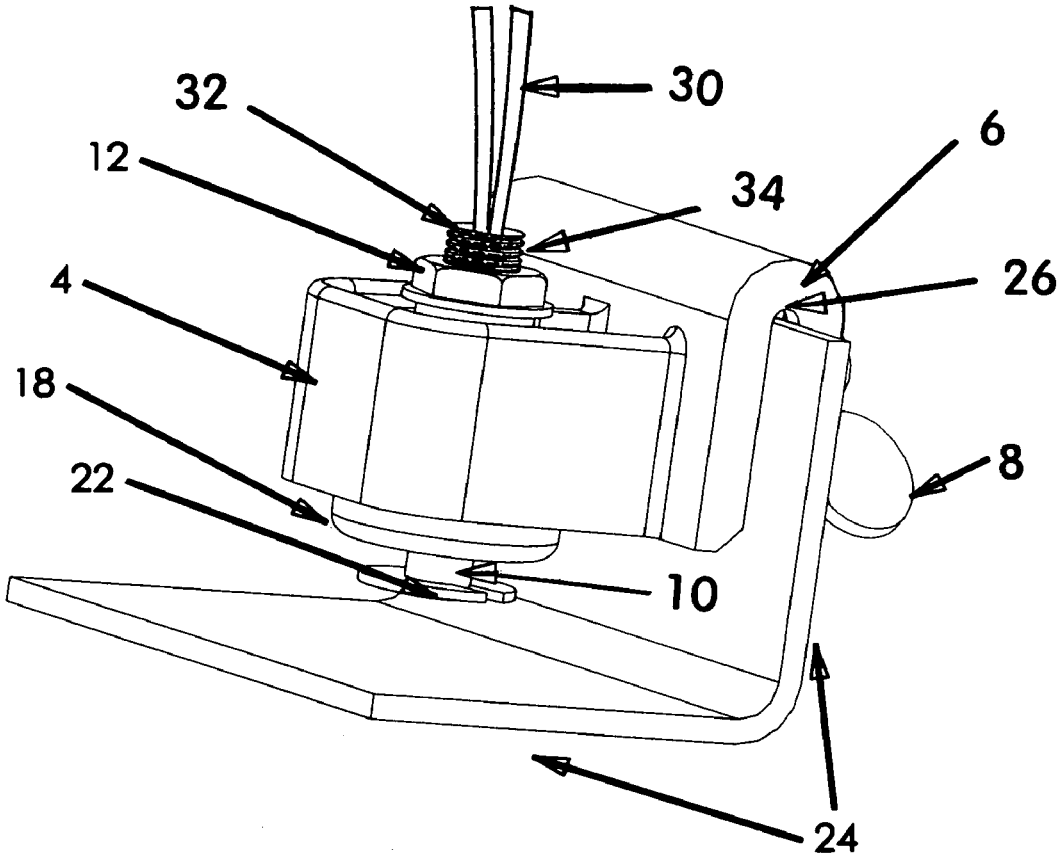

FIG. 7 is a perspective view of the most preferred embodiment of the present invention being supported by the vertically-extending wall of a fluid collection pan in a position where the disk-shaped stop at the bottom end of the shaft that extends through the housing remains above the horizontally-extending bottom surface of the collection pan, with a crushable friction point within the mounting bracket slot being shown in direct contact with the top edge of the upstanding collection pan wall.

DETAILED DESCRIPTION OF THE INVENTION

While FIGS. 1–7 show the most preferred embodiment of the present invention, it is to be understood that many variations in the present invention are possible and also considered to be a part of the invention disclosed herein, even though such variations are not specifically mentioned or shown. As a result, a reader should determine the scope of the present invention by the appended claims.

Figure 1:
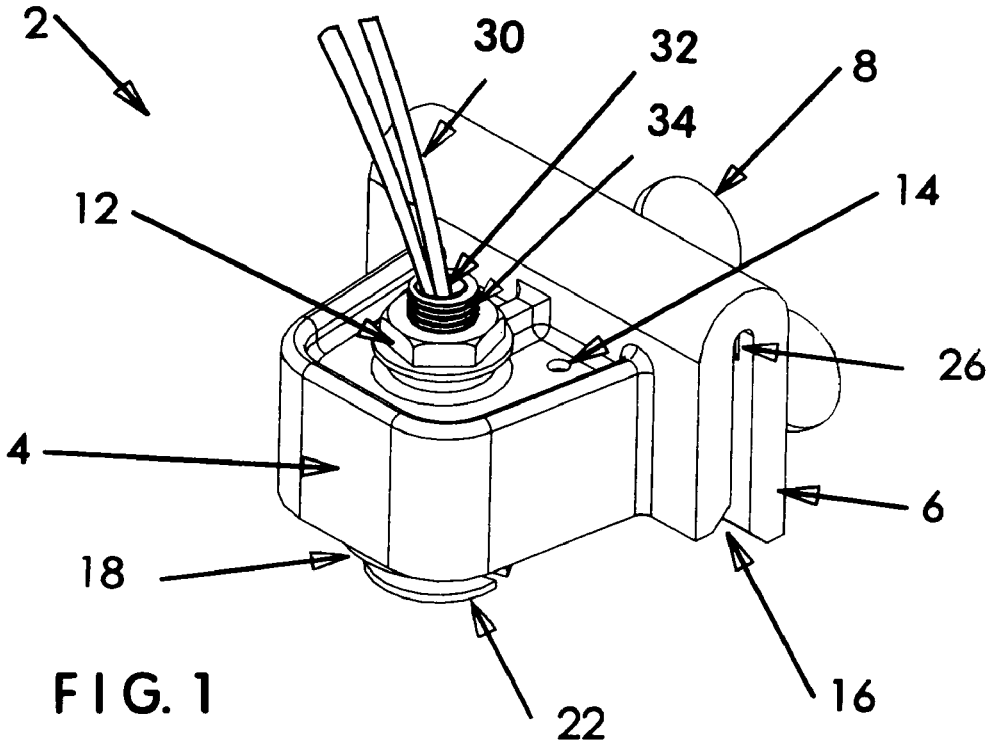
FIG. 1 is a perspective front view of the most preferred embodiment of the present invention having a housing/shroud with one visible air vent opening, a vertically-oriented hollow shaft with an upper threaded portion that is secured centrally within the protective housing/shroud by a lock-nut, a pair of lead wires extending upwardly through the top opening in the shaft, a float switch body positioned within the housing/shroud concentric to the shaft and guided by the shaft for vertical movement in response to water depth changes, a disk-shaped stop being attached to the lower end of the shaft to prevent the float switch body from moving downwardly below the shaft, and a substantially U-shaped mounting bracket depending from one side of the housing, with the bracket having an upwardly directed slot, crushable friction points in the upper portion of the slot, and multiple thumbscrews that are used to secure the bracket slot over the top edge of a fluid collection container that is at risk for fluid overflow without an accompanying depth-activated shut-off device.
Figure 2:
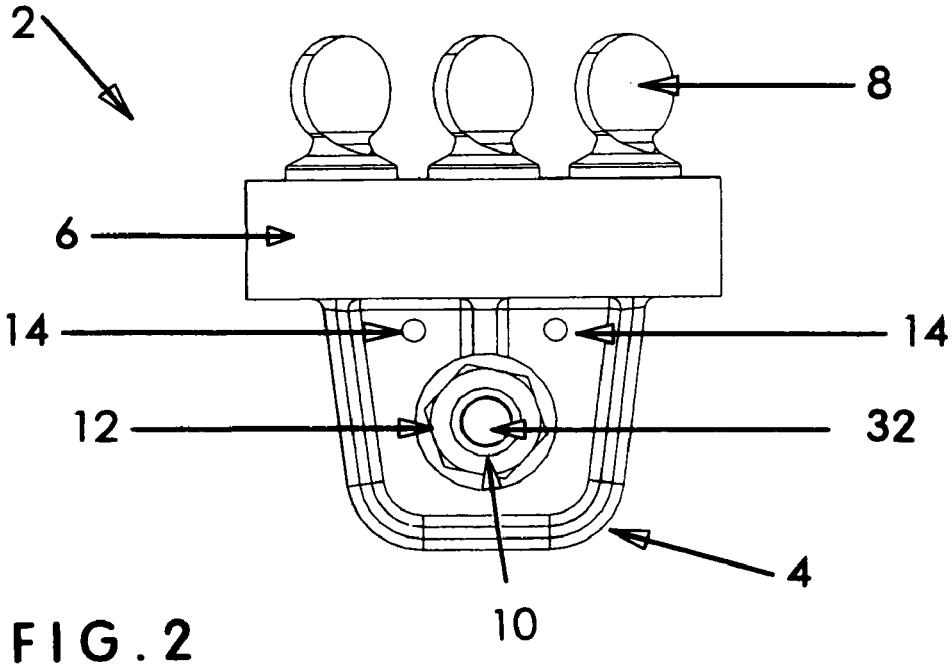
FIG. 2 is top view of the most preferred embodiment of the present invention having a housing/shroud with two visible air vent openings, a vertically-oriented hollow shaft secured in place centrally through the upper surface of the protective housing/shroud by a lock-nut, and a mounting bracket depending from one side of the housing/shroud, with three visible thumbscrews through the side of the mounting bracket remote from the housing/shroud, the thumbscrews being used to secure the mounting bracket to the top edge of a support surface extending through the upwardly directed slot shown in FIG. 1.
Figure 3:
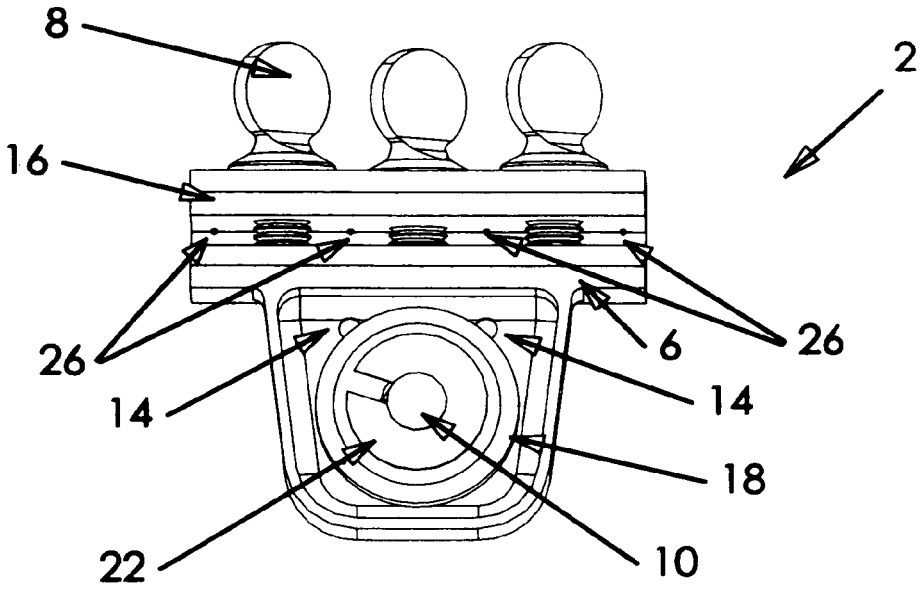
FIG. 3 is bottom view of the most preferred embodiment of the present invention having a housing/shroud with two visible air vent openings through its remotely observed top surface, a vertically-oriented shaft extending through the housing/shroud with a float switch body concentrically positioned around it, a disk-shaped stop attached to the lower end of the shaft below the float switch body, a mounting bracket depending from one side of the housing/shroud with three visible thumbscrews that are used to secure the mounting bracket to the upper portion of a support surface extending through the slot, and a plurality of crushable friction points in the upper portion of the slot that assist in stable installation of the mounting bracket to the support surface.

FIG. 1 shows the most preferred embodiment 2 of the present invention having a protective housing 4 with one visible air vent opening 14 through its top surface, a vertically-oriented shaft 10 with a top opening 32 and a threaded upper end 34 (otherwise hidden in FIG. 1, but visible in FIG. 5) that is secured centrally through the top surface of protective housing 4 by a lock-nut 12, and a U-shaped mounting bracket 6 with an upwardly-extending slot 16 depending from one of the sides of housing 4. FIG. 1 also reveals a float switch body 18 positioned within housing 4 and a disk-shaped stop 22 being attached to the lower end of shaft 10 to define the lower boundary for movement of float switch body 18. Although FIG. 1 shows the height dimension of housing 4 as being insufficient to completely cover float switch body 18, the height dimension of housing 4 is not critical and can be greater or less than that shown in FIG. 1, as long as it is sufficiently large to fulfill its primary function of protecting float switch body 18 from malfunction due to interference by airborne debris. As can be clearly seen in FIG. 5, but not visible in FIG. 1, float switch body 18 is positioned around shaft 10 and concentric to it, being guided for vertical movement within housing 4 between the lower lock-nut 12 and disk-shaped stop 22 by the non-threaded lower portion of shaft 10, and such movement being in response to changing fluid depth in the collection container or pan having its top edge secured within slot 6, such as but not limited to the collection pan 24 shown in FIG. 7. Although only one air vent opening 14 is visible in FIG. 1 through the top surface of housing 4, as one can see in FIGS. 2 and 3, two air vent openings 14 are used through the top surface of housing 4 to prevent airlock and potential malfunction of float switch body 18 as rising water moves upwardly into housing 4 through its open bottom end. FIG. 1 further shows mounting bracket 6 having a greater height dimension than housing 4, with the surplus height extending upwardly beyond the upper surface of housing 4. In addition, FIG. 1 shows the two arms of the U-shaped mounting bracket 6 being different lengths, with the arm remote from housing 4 being longer and extending below the bottom end of housing 4. The respective height dimensions of mounting bracket 6 and housing 4 are not critical, and either could be greater or less than that shown in FIG. 1. However, since mounting bracket 6 must have sufficient height dimension to provide a sturdy connection for housing 4 to the upper portion of a fluid collection container or pan, it is contemplated that in most applications the height dimension of mounting bracket 6 would not be significantly less than the height dimension of housing 4. Similarly, the relative lengths of the downwardly-extending arms of the U-shaped mounting bracket 6 are not critical, and their lengths can vary relative to one another, as well as relative to housing 4. However, in many contemplated applications, it is preferred that the length of the arm of mounting bracket 6 positioned remotely from housing 4 would be the same length or longer than the length of the arm of mounting bracket 6 positioned adjacent to housing 4, and also preferred that the length of the arms of mounting bracket 6 not extend too far below the bottom end of housing 4 without appropriate benefit to reduce manufacturing cost. Similarly, while the thickness/width dimensions of the arms of mounting device 6 and slot 16 are not critical, they must be properly dimensioned to achieve a sustained stable positioning of housing 4 during its use without unnecessary material expense. Further, on the arm of mounting bracket 6 positioned remotely from housing 4, FIG. 1 shows two thumbscrews 8 that are used to secure mounting bracket 6 in an operable position over the top edge of an upstanding support structure, such as but not limited to the vertically-extending fluid collection pan wall 24 shown in FIG. 6. As shown in FIGS. 2 and 3, the use of three pressure screws 8 is preferred, however, the number of thumbscrews 8 used, as well as their size and positioning, are not critical as long as secure attachment of mounting bracket 6 to the support surface is achieved so as to indefinitely sustain housing 4 in its original level orientation without unneeded material expense. FIG. 6 shows the preferred configuration and pattern of placement for the openings 28 through the arm of mounting bracket 6 positioned remotely from housing 4 that are used to receive the three thumbscrews 8. In addition, FIG. 1 shows one crushable friction point 26 within the upper end of slot 16 that is used to further secure the attachment between mounting bracket 6 and the support surface positioned in part within slot 6, such as but not limited to the vertically-extending fluid collection pan wall 24 shown in FIG. 7. Multiple spaced-apart crushable friction points 26 are contemplated in the present invention, as shown in FIG. 6, on the upper inside surface of the arm of mounting bracket 6 positioned remotely from housing 4. Although not shown in FIGS. 1–7, the use of multiple spaced-apart crushable friction points 26 on the upper inside surface of the arm of mounting bracket 6 positioned adjacent to housing 4 is also contemplated, but not critical. FIG. 1 further shows the upper end of shaft 10 having a pair of lead wires 30 extending upwardly from the top opening 32 in shaft 10. When lead wires 30 are connected into the circuit of the system generating the fluid to be collected in the container or pan to which the present invention mounting device 6 is attached, rising fluid in the container or pan will cause the present invention float switch body 18 to similarly rise, and when the depth of the fluid reaches a pre-determined height, the system's circuit will either be interrupted or completed so as to suspend the generation of additional fluid. Although not shown, for favorable installation and use in new applications, it is contemplated for lead wires 30 to be longer than wires typically provided in prior art float switches and for float switch body 18 to have higher amperage than prior art float switches.

FIG. 2 shows the most preferred embodiment 2 of the present invention having a housing 4 with two visible air vent openings 14 through its top surface, a vertically-oriented shaft 10 with and top opening 32 secured in place centrally through the top surface of protective housing 4 by a lock-nut 12, and mounting bracket 6 depending laterally outward from one of the sides of housing 4. FIG. 2 also shows three thumbscrews 8 connected to mounting bracket 6 in a position remote from housing 4 that are used to secure mounting bracket 6 to a support surface, such as but not limited to the top edge of the upstanding wall of collection pan 24 shown in FIG. 7. The number of thumbscrews 8 used is not critical as long as a sufficient number are used for secure positioning of mounting bracket 6 and unnecessary material expense is avoided. The three thumbscrews 8 in FIG. 2 are shown to be oversized relative to mounting bracket 6, although not limited thereto. However, it is preferred that thumbscrews 8 be sufficiently large for easy and confident manipulation by an adult human hand. Although FIG. 2 shows shaft 10 having a hollow top opening 32, the lead wires 30 that would typically extend from top opening 32 have been omitted for clarity of illustration. The positioning of air vent openings 14 relative to one another, and to housing 4, can be different from that shown in FIG. 2. Also, the size and configuration of air vent openings 14 can be different from that shown in FIG. 2, as long as in combination the air vent openings 14 used prevents airlock within housing 4 and such air vent openings 14 are not so large as to allow the entrance of a significant quantity of airborne debris into housing 4. Further, although FIG. 2 shows housing 4, mounting bracket 6, and the enlarged distal ends of thumbscrews 8 having no surface texture, it is contemplated for each to have any texture or decorative enhancement that does not interfere with its function.

FIG. 3 shows the most preferred embodiment 2 of the present invention having a protective housing 4 with an open bottom end through which the two visible air vent openings 14 through the inside top surface of housing 4 are viewed. A shaft 10 is centrally positioned within housing 4, with a float switch body 18 also being positioned within housing 4 concentrically around shaft 10. A disk-shaped stop 22 is attached to the lower end of shaft 10, below float switch body 18 to function as a lower boundary for float switch body 18 movement. FIG. 3 further shows a mounting bracket 6 depending laterally outward from one of the sides of housing 4. Three thumbscrews 8 extend through the arm of the substantially U-shaped mounting bracket 6 remote from housing 4 and into slot 16. In spaced-apart positions between thumbscrews 8, FIG. 3 shows several crushable friction points 26 that are used for additional enhancement of a non-slip connection between mounting bracket 6 and its support surface, such as but not limited to the upstanding wall of the collection pan shown in FIG. 7. Also in FIG. 3, the manipulated ends of the thumbscrews 8 appear large relative to mounting bracket 6, with the large configuration being preferred to facilitate ease of use. It is not contemplated for the number of thumbscrews 8, air vent openings 14, or crushable friction points 26 in the present invention to be limited to that shown in FIG. 3.

Figure 4:
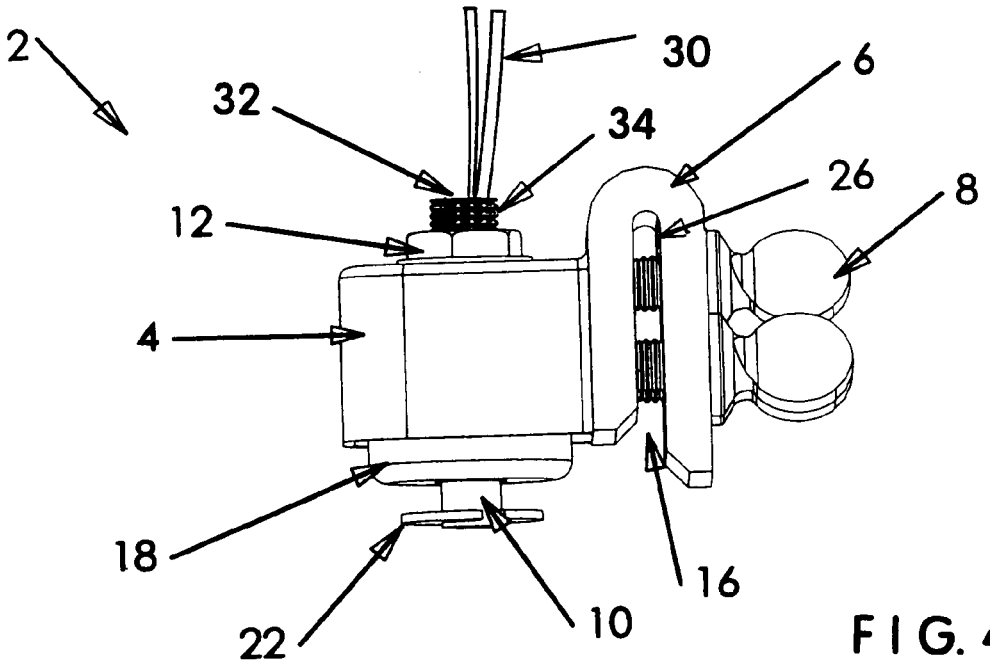
FIG. 4 is a side view of the most preferred embodiment of the present invention having a housing/shroud with a U-shaped mounting bracket depending from one of its sides, an upwardly-extending slot within the mounting bracket, a shaft centrally positioned within the housing/shroud, the threaded top portion of the shaft extending above the housing/shroud where it is secured by a lock-nut, a disk-shaped stop attached to the lower end of the shaft that defines the lower boundary of float switch body movement, a float switch body positioned within the housing/shroud and substantially filling it, the float switch body supported concentrically on the shaft above the stop for vertical movement in response to changing water depth in an associated water collection container or pan, and multiple thumbscrews attached through one arm of the U-shaped mounting bracket and extending into the slot for use in securing the bracket to a support surface that has its upper edge also positioned within the slot.

FIG. 4 shows the most preferred embodiment 2 of the present invention having a housing 4 with a mounting bracket 6 that in part extends above and below housing 4. Housing 4 substantially covers float switch body 18 to keep airborne debris (not shown) from preventing its proper function. Since it is contemplated for the upper portion of a fluid collection pan or other upstanding support surface to be inserted into slot 16 and for the thumbscrews 8 to each be advanced toward slot 6 until it firmly engages the support surface and provides a secure connection between the support surface and mounting bracket 6, the height dimensions of housing 4 and the arms of U-shaped mounting bracket 6 are not critical or limited to that shown in FIG. 4. Further, FIG. 4 shows the disk-shaped stop 22 being secured to the lower end of shaft 10. By raising and lowering stop 22 relative to shaft 10, stop 22 can be used as a means of adjusting the maximum vertical displacement of float switch body 18 according to a specific application or need. In the alternative, although not shown, a second stop 22 with the same or different thickness dimension could be used in addition to, or in place of the stop 22 shown in FIG. 4, as an alternative means of vertical displacement adjustment. FIG. 4 further shows the threaded top surface 34 of the shaft 10 extending above housing 4 where it is secured by a lock-nut 12, float switch body 18 substantially filling the interior space within housing 4, the float switch body 18 being supported concentrically on shaft 10 above stop 22, one crushable friction point 26 positioned against the upper rear interior surface of slot 6, and lead wires 30 extending upwardly through the top opening 32 in shaft 10.

Figure 5:
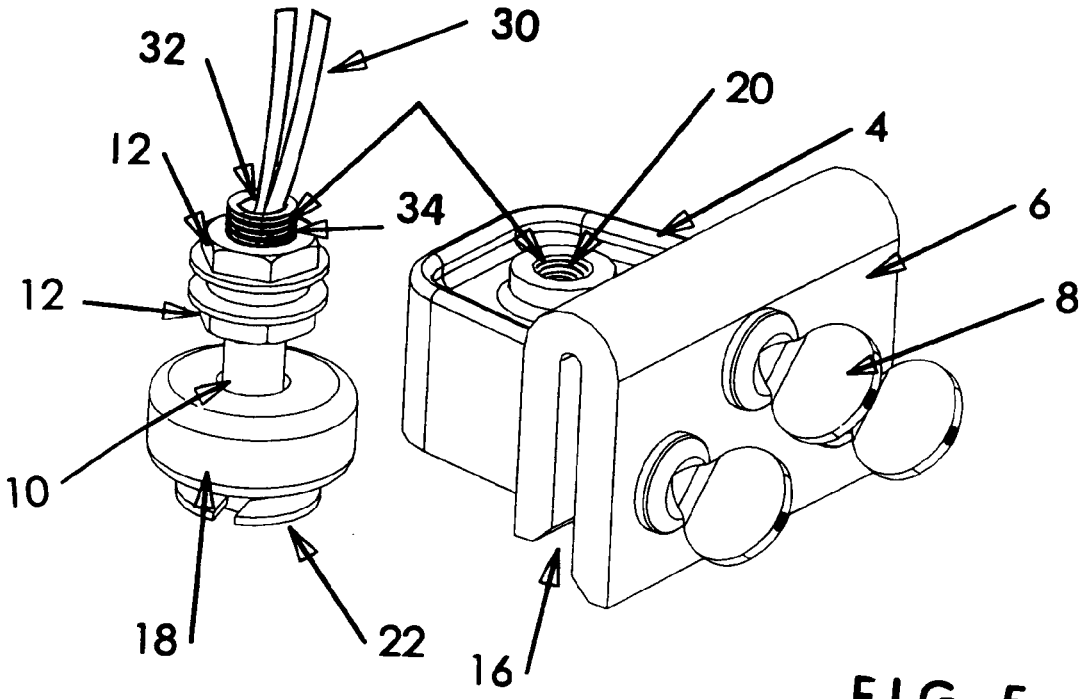
FIG. 5 is a partial exploded view of the most preferred embodiment of the present invention having a housing/shroud with a threaded central bore in its upper surface that is sized and configured for insertion therethrough of the threaded upper portion of a shaft, a float switch body concentrically positioned around the non-threaded lower portion of the shaft, two lock-nuts secured to the threaded upper portion of the shaft with the lower lock-nut providing the upper boundary of float switch body movement, a disk-shaped stop secured to the bottom end of the shaft providing the lower boundary of float switch body movement, a U-shaped mounting bracket with an upwardly-extending slot depending from one side of the housing/ shroud, and multiple thumbscrews through one arm of the U-shaped mounting bracket that are used to secure the mounting bracket to a fluid collection container that has its top edge inserted into the slot.

FIG. 5 shows the most preferred embodiment of the present invention having a housing 4 with a threaded central bore 20 that is configured for vertical insertion of the upper threaded surface 34 of a shaft 10. Two lock-nuts 12 are used to secure shaft 10 centrally within housing 4, and a disk-shaped stop 22 is attached to the bottom end of shaft 10. FIG. 5 further shows a float switch body 18 concentrically positioned around shaft 10 for free longitudinal movement along shaft 10, with lock-nuts 12 defining the upper boundary of float switch body 18 movement and stop 22 defining the lower boundary of float switch body 18 movement. The mounting bracket 6 depending from one of the sides of housing 4 has an inverted U-shaped configuration and an upwardly directed slot 16 into which the upper portion of a support surface (such as support surface 24 shown in FIG. 7) would be inserted during use. Three thumbscrews 8 are used for securely positioning mounting bracket 6 so that the float switch body 18 within housing 4 can operate without wobbling or other interference that could adversely affect its function. Although FIG. 5 shows the upper surface of mounting bracket 6 extending above the top surface of housing 4, the relative sizes of housing 4 and mounting bracket 6 are not critical as long as each is sufficiently large to fulfill its intended function without undue material waste.

FIG. 6 shows the interior surface of the one of the arms of the most preferred mounting bracket 6 of the present invention that is remotely positioned from housing 4. The interior surface of mounting bracket 6 shown, with the other half of mounting bracket 6, together provide the perimeter definition for slot 16. A plurality of spaced-apart stabilizing crushable friction points 26 are visible near the top interior surface shown, and three spaced-apart threaded openings 28 that are each configured for securely holding a thumbscrews 8 are positioned below crushable friction points 26. The number, size, positioning, spacing, and configuration of crushable friction points 26 are not critical, as long as crushable friction points 26 fulfill their support surface gripping function. The number, size, positioning, spacing, and configuration of threaded openings 28 are also not critical, as long as they permit the thumbscrews 8 they support to firmly grip the support surface to which mounting bracket 6 is attached. Also, the thickness dimension for the arms of U-shaped mounting bracket 6 shown in FIG. 6 is not meant to be limiting. Although not shown, the other arm of mounting bracket 6 may optionally have crushable friction points 26 similar in number, size, spacing, location, and/or configuration to those shown in FIG. 6, or different.

FIG. 7 shows the most preferred embodiment of the present invention being supported over the bottom surface of a fluid collection container or pan 24 by its mounting bracket 6 secured over the top edge of an upstanding surface belonging to the same container or pan 24. One crushable friction point 26 is shown rearward from the upstanding surface of container or pan 24 and in direct contact with its upper edge. In its mounted position to container or pan 24, stop 22 remains a spaced-apart distance above the bottom surface of container or pan 24, with the distance of stop 22 above the bottom surface of container or pan 24 being determined by the relative height dimensions of shaft 10 and the upstanding surface of container or pan 24, which are not limited to that shown in FIG. 7. FIG. 7 also shows portions of two of the thumbscrews 8 being used to tighten mounting bracket 6 into a secure position relative to the upstanding surface of container or pan 24. FIG. 7 further shows lock-nut 12 being used to secure the upper threaded portion 34 of shaft 10 to housing 4, with the remaining portion of shaft 10 extending centrally through housing 4 and beyond its bottom open end. Lead wires 30 are shown upwardly extending from the top opening 32 in shaft 10, and float switch body 18 is shown extending downwardly below housing 4, with stop 22 providing the lower boundary of float switch body 18 movement.

The materials from which the most preferred embodiment 2 is made can vary, but must be impervious to corrosion. Preferably for cost considerations, although not limited thereto, it is contemplated for housing 4, float switch body 18, stop 22, mounting bracket 6, thumbscrews 8, shaft 10, and lock-nuts 12 to all be made from plastic. Resistance to UV radiation is not necessarily a contemplated feature of the present invention, unless dictated by the application. Manufacture of the present invention could be accomplished by blow molding, injection molding, assembly of pre-formed individual components, or a combination thereof, with the choice of manufacturing being determined by the anticipated purchase cost to consumers and the expected duration of use without maintenance, parts replacement, or repair. Although size of the present invention is not critical, for many condensate collection applications, the length, width, and height dimensions of the combined housing 4 and mounting bracket 6 would be less than two inches, and in some applications a housing 4 width would be no larger than one-and-one-fourth inches. It is also contemplated for the most preferred embodiments of the present invention to have a minimum switching capacity of approximately three Amps., instead of the one-and-one-half Amp. or less switching capacity used by prior art float switches (not shown), and for lead wires 30 to be at least eight feet in length.

Prior to use of the most preferred embodiment of the present invention, float switch body 18 would be positioned on shaft 10 so that lead wires 30 extend through top end 32. Preferably, the upper threaded portion 34 of shaft 10 would then be inserted through threaded central bore 20 and secured to the top surface of housing 4 with the two lock-nuts 12 so that the remainder of shaft 10 is vertically extending through housing 4 with float switch body 18 substantially filling the interior space within housing 4. Stop 22 would be fixed to the bottom end of shaft 10 to define the lower boundary of float switch body 18 movement vertically along shaft 10 during use. Coarse adjustment of the needed vertical displacement of float switch body 18 would be accomplished by repositioning stop 22, lock-nuts 12, or both, on shaft 10. Housing 4 may completely, or only substantially, cover float switch body 18. To facilitate installation, it is contemplated that mounting bracket 6 would already be attached to housing 4, with thumbscrews 8 already attached to mounting bracket 6. Thus, it is contemplated that all an operator/installer would have to do is place slot 16 over the top edge of the upstanding wall of a condensate collection container or pan 24, such as but not limited to the container or pan 24 shown in FIG. 7, so that crushable friction points 26 engage a portion of container or pan 24. Thumbscrews 8, would then be tightened to further secure mounting bracket 6 against the upstanding wall of collection container or pan 24 to stabilize the positioning of housing 4 during use for reliable vertical movement of float switch body 18 within housing 4. No drilling of holes through the upstanding wall of container or pan 24 is required. Once housing 4 is in its secured and usable position, the installer or operator would check it for the stable and level positioning required for reliable and uninhibited vertical movement of float switch body 18. Lead wires 30 would then be connected to the system providing water or other fluid collected by container or pan 24. Then, when collected fluid fills container or pan 24 beyond a pre-determined depth that is considered to be safe to prevent overflow, the present invention float switch body 18 is lifted by the rising fluid to the height that interrupts the system's operation and stop additional fluid collection in container or pan 24. As fluid rises in container or pan 24, air vent openings 14 through the top surface of housing 4 prevent the creation of an airlock within housing 4 that could potentially interfere with the proper vertical movement of float switch body 18. Minimal maintenance is contemplated. Housing 4 would protect the movement of float switch body 18 from interference due to airborne debris (not shown), such as the fibers found in attic insulation. If housing 4 is made from translucent, transparent, or partially transparent materials, an operator could visibly assess the effective operation of float switch body 18 without removing it from housing 4 or separating mounting bracket 6 from container or pan 24. The size, configuration, and pattern of air vent openings 14 and thumbscrews 8 are not critical and can vary depending upon design and price point considerations, such as but not limited to ease of manufacture and effectiveness of operation. It is further contemplated for housing 4 and thumbscrews 8 to have a compact design and construction for efficient packaging and transport.

I claim:

1. A float switch and mounting bracket assembly for use in association with a fluid collection container having a top edge and an outside surface to shut off the system providing fluid to the container once a pre-determined fluid depth has been reached, said assembly comprising:

a housing having an open bottom end, a top surface, an interior space between said open bottom end and said top surface, at least two air vent openings through said top surface of sufficient size and spaced apart positioning to prevent airlock within said interior space as fluid rises therein, a substantially planar rear wall having a height dimension extending between said top surface and said open bottom end, and said housing also having a threaded bore centrally through said top surface;

a substantially U-shaped mounting device depending laterally outward from said housing, said mounting device having an upwardly-extending slot extending between two opposed arms, one of said opposed arms being positioned remotely from said housing and the other of said opposed arms depending from nearly the entire portion of said height dimension of said planar rear wall, and said mounting device further having at least one threaded opening through said remotely positioned arm;

a shaft with a threaded top portion secured within said threaded bore in said top surf ace of said housing, said shaft also having a bottom end with a stop extending below said open bottom end of said housing;

a float switch body concentric with said shaft and positioned for free movement along said shaft, said float switch body having a large surface area that enhances its buoyancy and substantially fills said interior space of said housing, said float switch body also extending in part below said open bottom end of said housing when the fluid collection container to which said assembly is connected contains no fluid;

threaded fastening means adapted for securely attaching said shaft to said threaded bore of said housing;

at least one thumbscrew configured and dimensioned to engage said at least one threaded opening through said remotely positioned arm; and lead wires connected between said float switch body and the system providing fluid to the collection container with which said assembly is associated, so that when the top edge of the container is positioned within said slot of said mounting device and said at least one thumbscrew is tightened in said at least one threaded opening through said remotely positioned arm and supported by said remotely positioned arm in a position where it is able to engage the outside surface of the fluid collection container, said float switch body is positioned to move freely along said shaft between said stop and said fastening means in response to rising and falling fluid levels in the attached container, and whereby when a pre-determined maximum depth of fluid accumulation is reached said float switch body shuts off the system to prevent fluid overflow in the container.

2. The assembly of claim 1 wherein said upwardly-extending slot has a top arcuate portion and further comprising a plurality of friction points adjacent to said top arcuate portion of said slot.

3. The assembly of claim 2 wherein said friction points are crushable so as to conform to and cause said mounting bracket to become securely positioned against an uneven surface.

4. The assembly of claim 3 wherein said crushable friction points depend from said remotely positioned arm.

5. The assembly of claim 1 wherein said fastening means comprises at least one lock-nut.

6. The assembly of claim 1 wherein said stop is separable from said shaft.

7. The assembly of claim 1 wherein said shaft has a top opening, and further wherein said lead wires are extended through said top opening.

8. The assembly of claim 1 wherein the maximum vertical movement of said float switch body along said shaft is adjustable.

9. The assembly of claim 1 wherein said float switch body is adjustable and further comprising a plurality of friction points extending into said slot.

10. The assembly of claim 1 wherein said float switch body has a minimum switching capacity of three Amps.

11. The assembly of claim 1 wherein said float switch body has a minimum switching capacity of three Amps.

12. A float switch and mounting bracket assembly for use in association with a fluid collection container having a top edge to shut off the system providing fluid to the container once a pre-determined fluid depth has been reached, said assembly comprising:

a housing having an open bottom end, a top surface, and interior space between said open bottom end and said top surface, at least two air vent openings through said top surface configured to prevent airlock within said interior space as fluid rises therein, a substantially planar rear wall having a height dimension extending between said top surface and said open bottom end, and a threaded bore centrally through said top surface;

a substantially U-shaped mounting device depending laterally outward from said full height dimension of said housing, said mounting device having an upwardly-extending slot, one arm of the U-shaped configuration positioned remotely from said housing, and at least one threaded opening through said remotely positioned arm;

a shaft with a threaded top portion secured within said threaded bore in said top surface of said housing, said shaft also having a bottom end with a stop;

a float switch body concentric with said shaft and positioned for free and adjustable movement along said shaft;

at least one lock-nut configured and dimensioned to firmly fix said shaft within said threaded bore of said housing;

at least one thumbscrew configured and dimensioned to engage said at least one threaded opening through said remotely positioned arm; and lead wires connected between said float switch body and the system providing fluid to the collection container with which said assembly is associated, so that when the top edge of the container is positioned within said slot of said mounting device and said at least one thumbscrew is tightened in said at least one threaded opening through said remotely positioned arm, said float switch body is positioned to move freely along said shaft between said stop and said fastening means in response to rising and falling fluid levels in the attached container, and whereby when a pre-determined maximum depth of fluid accumulation is reached said float switch body shuts off the system to prevent fluid overflow in the container.

13. The assembly of claim 12 wherein said upwardly-extending slot has a top arcuate portion and further comprising a plurality of friction points extending within said top arcuate portion of said slot.

14. The assembly of claim 13 wherein said friction points are crushable so as to conform to and cause said mounting bracket to become securely positioned against an uneven surface.

15. The assembly of claim 14 wherein said crushable friction points depend from said remotely positioned arm.

16. A float switch and mounting bracket assembly for use in association with a fluid collection container having a top edge and an outside surface to shit off the system providing fluid to the container once a pre-determined fluid depth has been reached, said assembly comprising:

a housing having an open bottom end, a top surface, an interior space between said open bottom end and said top surface, at least two air vent openings through said top surface configured to prevent airlock within said interior space as fluid rises therein, a substantial planar wall having a height dimension extending between said top surface and said open bottom end, and a threaded bore centrally through said top surface;

a substantially U-shaped mounting device depending laterally outward from said housing, said mounting device having an upwardly-extending slot with a top portion, a plurality of friction points within said top portion of said slot, one arm of the U-shaped configuration positioned remotely from said housing, and at least one threaded opening through said remotely positioned arm;

a shaft with a threaded top portion secured within said threaded bore in said top surface of said housing, said shaft also having a bottom end with a stop;

a float switch body concentric with said shaft and positioned for free and adjustable movement along said shaft, said float switch body having a large surface area that enhances its buoyancy and substantially fills said interior space of said housing;

at least one lock-nut configured and dimensioned to firmly fix said shaft within said threaded bore of said housing;

at least one thumbscrew configured and dimensioned to engage said at least one threaded opening through said remotely positioned arm; and lead wires connected between said float switch body and the system providing fluid to the collection container with which said assembly is associated, so that when the top edge of the container is positioned within said slot of said mounting device and said at least one thumbscrew is tightened in said at least one threaded opening through said remotely positioned arm, said float switch body is positioned to move freely along said shaft between said stop and said fastening means in response to rising and falling fluid levels in the attached container, and whereby when a pre-determined maximum depth of fluid accumulation is reached said float switch body shuts off the system to prevent fluid overflow in the container.

17. The assembly of claim 16 wherein said friction points are crushable so as to conform to and cause said mounting bracket to become securely positioned against an uneven surface.

18. The assembly of claim 17 wherein said crushable friction points depend from said remotely positioned arm.

19. The assembly of claim 16 wherein said float switch body has a minimum switching capacity of three Amps.

20. The assembly of claim 16 wherein said lead wires have a minimum length dimension of approximately eight feet.

* * * * *